US005473970A

United States Patent [19]

Hayashi et al.

[11] Patent Number: 5,473,970

[45] Date of Patent: Dec. 12, 1995

[54] INTERLOCKING CHANGE-OVER VALVE SYSTEM

[75] Inventors: Hiroshi Hayashi, Yamaguchi; Tadashi Miyoshi, Kudamatsu, both of Japan

[73] Assignees: Toshihiro Industry Co., Ltd., Yanai; Miyoshi Co., Ltd., Kudamatsu, both of Japan

[21] Appl. No.: 278,096

[22] Filed: Jul. 21, 1994

[30] Foreign Application Priority Data

Mar. 3, 1992 [JP] Japan ..... 4-020340

[51] Int. Cl.[6] ..... F15B 11/00; F15B 13/00

[52] U.S. Cl. ..... 91/523; 91/527; 91/530

[58] Field of Search ..... 91/521, 523, 461, 91/525, 524, 527, 529, 530, 462, 465, 466, 467; 137/869, 864, 596.18; 414/909, 701

[56] References Cited

U.S. PATENT DOCUMENTS

| | | | |
|---|---|---|---|
| 718,973 | 1/1903 | Reymond | 91/529 |
| 1,279,027 | 9/1918 | Hall | 91/465 |
| 3,156,255 | 11/1964 | Gasquet et al. | 91/529 |
| 3,589,242 | 6/1971 | Peterson | 91/523 X |
| 3,788,425 | 1/1974 | Balogh | 91/529 X |
| 4,358,242 | 11/1982 | Davies | 414/909 X |
| 4,738,103 | 4/1988 | Tha | 91/329 X |
| 4,983,526 | 1/1991 | Suga et al. | 436/55 |

FOREIGN PATENT DOCUMENTS

| | | | |
|---|---|---|---|
| 590769 | 1/1960 | Canada | 91/528 |
| 61-207728 | 9/1986 | Japan . | |
| 62-240295 | 10/1987 | Japan . | |

*Primary Examiner*—Edward K. Look
*Assistant Examiner*—Hoang Nguyen
*Attorney, Agent, or Firm*—Finnegan, Henderson, Farabow, Garrett and Dunner

[57] ABSTRACT

An interlocking change-over valve system for use in a hydraulically controlled mechanism includes a plurality of hydraulic actuators and at least one valve corresponding to each actuator for controlling the hydraulic pressure supplied to each actuator. A hydraulic cylinder communicates with each valve for opening and closing the valve. A control device remotely activates the hydraulic cylinder to selectively supply hydraulic pressure to some of the hydraulic actuators.

7 Claims, 2 Drawing Sheets

INTERLOCKING CHANGE-OVER VALVE SYSTEM

BACKGROUND OF THE INVENTION

1. Field of the Invention

The present invention relates an interlocking change-over valve system. More specifically, the present invention relates to an interlocking change-over valve system for use in a hydraulic control mechanism such as a rotary bucket mounted on a swing arm of a power-assisted shovel truck.

2. Discussion of the Related Art

Conventional hydraulic valve control mechanisms for use in power-assisted shovel trucks or jib cranes include a plurality of independent valves. The valves are activated and controlled directly or indirectly by an operator located within a gondola of the truck or crane. Often, electromagnetic spool valves are used, requiring difficult fine adjustments and causing vibrations to occur.

When a rotary bucket, as disclosed in, for example, Japanese Patent Laid-Open Nos. 207728/1986 and 240295/1987, is mounted on the front end of a swing arm of the shovel truck, a large number of hydraulic actuators (hydraulic cylinders, hydraulic motors, etc.) are needed as the bucket requires movement in a variety of directions. However, as the number of hydraulic actuators increases, the hydraulic pressure typically decreases. As a result, operations slow or the force of operation weakens when a multitude of hydraulic actuators are used simultaneously unless the hydraulic pressure source, such as an oil pump or a hydraulic pressure tank, is very large.

In addition, in conventional spool valves, the pilot hydraulic pressure and the hydraulic pressure for operation pass through a complex network resulting in high pressure loss and slow operation. Moreover, electromagnetic valves, which permit the passage of large amounts of pressurized fluid, are very expensive and difficult to employ.

SUMMARY OF THE INVENTION

The present invention has been made in view of the above circumstances and has as an object to provide interlocking change-over valves capable of switching between two or more hydraulic pressure passages through a simple manual remote operation.

A further object of the present invention is to provide a hydraulic pressure valve control system for use in a power-assisted shovel truck equipped with a rotary bucket. The control system controls the hydraulic pressure distribution to the various valves for ultimately moving the rotary bucket in a variety of directions and ways.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the interlocking change-over valve system for use in a hydraulically controlled mechanism includes a plurality of hydraulic actuators and at least one valve corresponding to each of the plurality of actuators for controlling the hydraulic pressure supplied to the actuator. A hydraulic cylinder communicates with each of the at least one valve for opening and closing the valve. A control device remotely activates the hydraulic cylinder to selectively supply hydraulic pressure to some of the plurality of hydraulic actuators.

In another aspect, an interlocking change-over valve system is provided including a hydraulically controlled mechanism, a pair of hydraulic cylinder actuators, and a pair of hydraulic motor actuators. The cylinder actuators and motor actuators control the movement of the mechanism. A pair of valves correspond to each of the pair of cylinder actuators and the pair of motor actuators for controlling the hydraulic pressure supplied to the actuator. A first hydraulic cylinder communicates with the valves corresponding to the cylinder actuators for opening and closing the valves. A second hydraulic cylinder communicates with the valves corresponding to the motor actuators for opening and closing the valves. A first control device remotely activates the first hydraulic cylinder to selectively supply hydraulic pressure to one of the pair of cylinder actuators. A second control device remotely activates the second hydraulic cylinder to selectively supply hydraulic pressure to one of the pair of motor actuators.

BRIEF DESCRIPTION OF THE DRAWINGS

The accompanying drawings, which are incorporated in and constitute a part of this specification, illustrate an embodiment of the invention and, together with the description, serve to explain the objects, advantages and principles of the invention. In the drawings.

DETAILED DESCRIPTION OF THE PREFERRED EMBODIMENT

The present invention relates to a valve system used to control the operation and positioning of a hydraulically controlled mechanism. The valve system is particularly suited for operating a rotary bucket of a power-assisted shovel truck and will be described herein in that respect. A detailed description of a rotary bucket of a shovel truck is disclosed in commonly owned U.S. patent application Ser. No. 08/278,095 entitled "Power-Assisted Shovel Truck Equipped With a Water-Feeding Device and a Water-Draining Device" filed on Jul. 21, 1994, which is hereby incorporated by reference. The rotary bucket as described exhibits four types of movement. The bucket includes a base and a main body that fully rotates with respect to the base. Secondly, the main body includes jaws that open and close to hold various items. Lastly, the entire bucket both swings and tilts through the use of, respectively, a hydraulic cylinder and a tilting link mechanism. Through these movements, the bucket attains various positions. The hydraulic pressure valve control system according to the present invention and described herein controls these movements.

Figure 1:
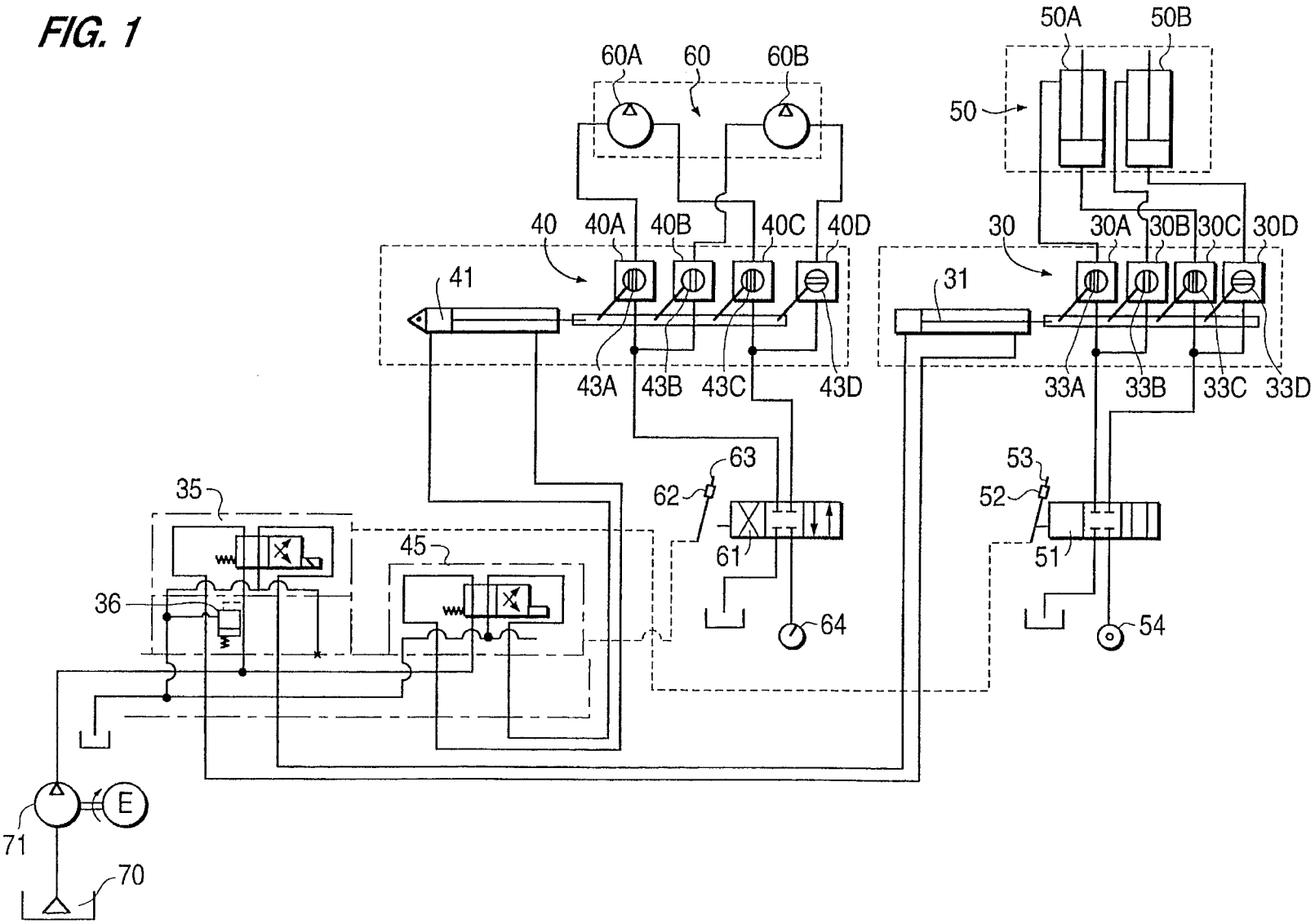
FIG. 1 is a circuit diagram illustrating a hydraulic pressure valve control system for use in a power-assisted shovel truck equipped with a rotary bucket.

FIG. 1 is a circuit diagram illustrating an embodiment of the hydraulic pressure valve control system of the present invention. A plurality of interlocking change-over valves 30 operate a group of hydraulic cylinders 50 that either tilt the rotary bucket or open and close the jaws of the bucket. More specifically, four valves 30A, 30B, 30C, and 30D open and close to supply hydraulic pressure to hydraulic cylinder 50A for tilting the bucket or hydraulic cylinder 50B for opening and closing the bucket. The valves 30 preferably have spherical valve members 33. The spherical valve members 33A and 33C of 30A and 30C are oriented similarly and deviated 90 degrees from the spherical valve members 33B and 33D of 30B and 30D. Thus, when valves 30A and 30C are opened, valves 30B and 30D are closed and the hydraulic cylinder 50A tilts the bucket. Likewise, when valves 30B and 30D are opened, valves 30A and 30C are closed and the hydraulic cylinder 50B opens and closes the jaws of the bucket.

Figure 2:
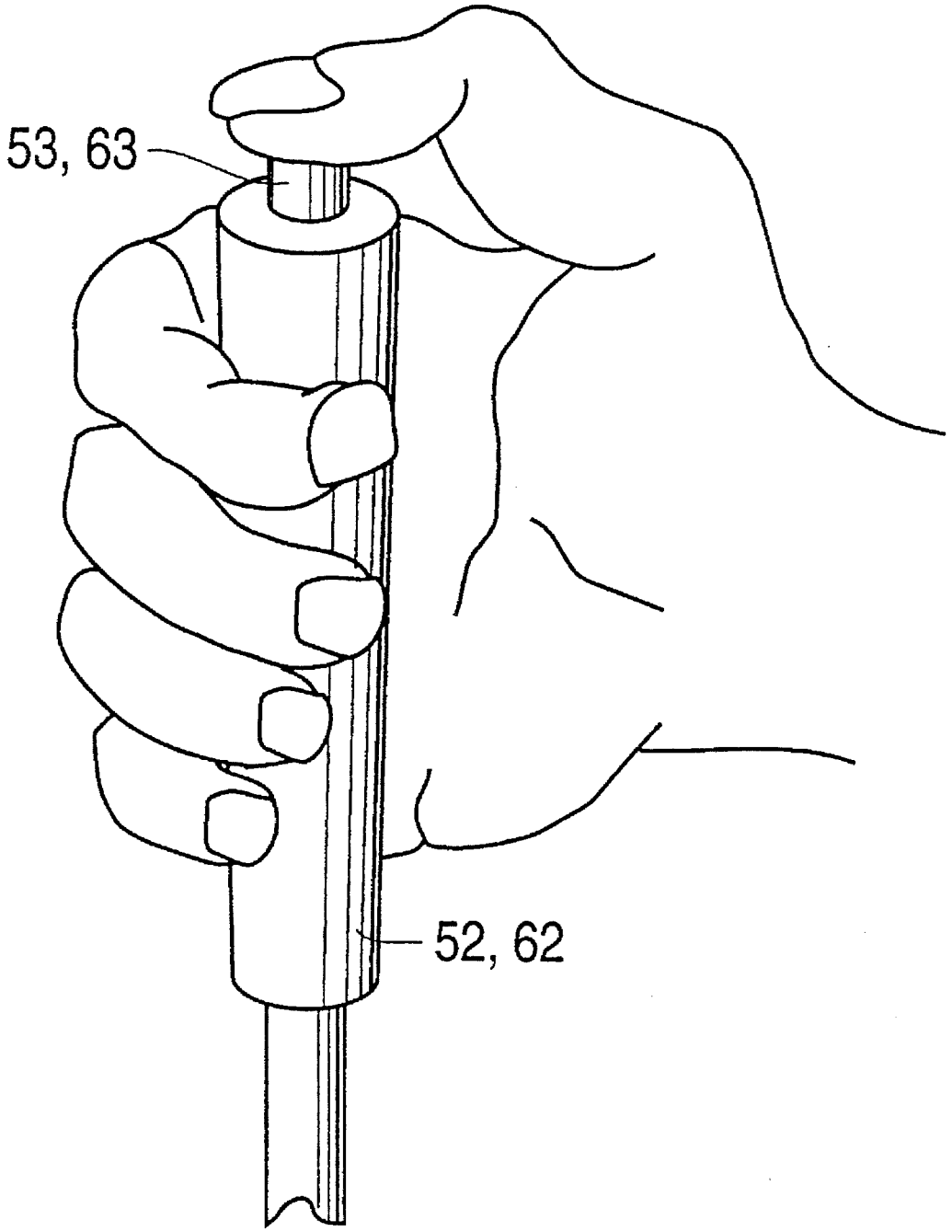
FIG. 2 is a perspective view of a lever and push-button used in the hydraulic pressure valve control system illustrated in FIG. 1.

An interlocking hydraulic cylinder 31 controlled by an electromagnetic valve 35 activates the valves 30. The electromagnetic valve receives a pilot voltage signal from a lever 52 that includes a manually operated push-button 53, as shown in FIG. 2. The lever 52 is remotely controlled by an operator within the gondola of the shovel truck. Based on whether the push-button 53 is depressed, the electromagnetic valve 35 supplies hydraulic pressure to the cylinder 31. The cylinder 31, which is connected to the valves 30 by a linking mechanism, will move to a position so that the links either open valves 30A and 30C or valves 30B and 30D.

The hydraulic pressure valve control system according to the present invention further includes a plurality of interlocking change-over valves 40 that operate a group of hydraulic motors 60 for swinging the main body of the entire bucket and for fully rotating the main body of the bucket. More specifically, four valves 40A, 40B, 40C, and 40D open and close to supply hydraulic pressure to hydraulic motor 60A for swinging the bucket or hydraulic motor 60B for rotating the bucket. Valves 40 preferably have spherical valve members 43, the members 43A and 43C oriented similarly and deviated 90 degrees from members 43B and 43D. Similar to the valves 30, when valves 40A and 40C are opened, valves 40B and 40D are closed and the hydraulic motor 60A swings the bucket. Likewise, when valves 40B and 40D are opened, valves 40A and 40C are closed and the hydraulic motor 60B rotates the bucket.

An interlocking hydraulic cylinder 41 controlled by an electromagnetic valve 45 activates the valves 40. The electromagnetic valve 45 receives a pilot voltage signal from a second lever 62 that includes a manually operated push-button 63, as shown in FIG. 2. The lever 62, as with lever 52, is remotely controlled by an operator within the gondola of the shovel truck. Based on whether the push-button 63 is depressed, the electromagnetic valve 45 supplies hydraulic pressure to the cylinder 41. The cylinder 41, which is connected to the valve 40 by a linking mechanism, will move to a position so that the links either open valves 40A and 40C or valves 40B and 40D. The levers 52 and 62 are located on the left and right of the operator so that both can be simultaneously controlled by both hands. A relief valve 36 is also included within the valve control system of the present invention.

At the direction of the electromagnetic valves 35 and 45, a hydraulic pump 71 driven by an engine E pumps oil from an oil tank 70 to the hydraulic cylinders 31 and 41 for activating the valves 30 and 40. The valve control system further includes sources of hydraulic pressure 54 and 64 for supply to valves 30 and 40. Sources 54 and 64 may be incorporated into the same arrangement that includes pump 71 and tank 70.

As mentioned hereinabove, the change-over valves 30 and 40 preferably have spherical valve members 33 and 43. The spherical valve members may have a cylindrical shape. However, a gap must be maintained with respect to the valve case to prevent channeling and leakage of hydraulic pressure.

The hydraulic valve control system as embodied in FIG. 1 further includes manually controlled valves 51 and 61. Valve 51, which is activated by lever 52 and push button 53, can selectively control the supply of hydraulic pressure to valves 30A and 30C or valves 30B and 30D to, in turn, control operation of the hydraulic cylinders 50A and 50B.

Similarly, valve 61 is activated by lever 62 and push button 63. The valve 61 can selectively control the supply of hydraulic pressure to valves 40A and 40C or valves 40B and 40D to, in turn, control operation of the hydraulic motors 60A and 60B.

As shown in Table 1 below, four combinations of bucket movement result from the control of the two levers 52 and 62. In the initial case, the bucket is tilted by the hydraulic cylinder 50A and swung by the hydraulic motor 60A. In this case, the hydraulic cylinders 31 and 41 are respectively located at positions X1 and Y1, the valves 30A, 30C, 40A, and 40C are opened, and the valves 30B, 30D, 40B, and 40D are closed. Thereby, the hydraulic cylinder 50A and hydraulic motor 60A receive hydraulic pressure from the sources 54 and 64 and the bucket main body can swing as it is tilted.

TABLE 1

| Hydraulic cylinder 31 Hydraulic cylinder 41 | X 1 | X 2 |
|---|---|---|
| Y1 | Tilting the bucket and swinging the main body | Opening and closing the bucket and swinging the main body |
| Y2 | Tilting the bucket and rotating the bucket | Opening and closing the bucket and rotating the bucket |

In the second case, the push-buttons 53 and 63 disposed at the upper ends of the levers 52 and 62 are manually depressed as shown in FIG. 2 to cause the jaws of the rotary bucket device to open and close and the bucket to rotate. The depression of the push-buttons 53 and 63 causes the hydraulic cylinders 31 and 41 to move to positions X2 and Y2 respectively as pilot voltage signals are sent to the electromagnetic valves 35 and 45. The electromagnetic valves 35 and 45 change the operations from the tilting of the bucket to the opening and closing of the bucket and from the swinging of the main body to the rotation of the bucket. Depression of the push-buttons again returns the interlocking change-over valves to their initial state, namely X1 and Y1.

It is to be understood that the push-buttons 53 and 63 can be depressed at different times. If, for example, the hydraulic cylinder 31 is located at position X2 and the hydraulic cylinder 41 at position Y1, then the bucket will open and close while the main body of the bucket swings. Similarly, if the hydraulic cylinder 41 is located at position Y2 and the hydraulic cylinder 31 at position X1, then the bucket can tilt while also rotating.

The valve control system is not limited to the combinations appearing in Table 1. For instance, in FIG. 1, the hydraulic cylinder 50A and the hydraulic motor 60B can be switched to select other combinations of operations.

It is also to be understood that any number of interlocking change-over valves can be incorporated into the valve control system of present invention. Valves numbering 2N, where N is a positive integer representing the number of hydraulic cylinders and motors to be controlled, can be operated in an interlocking manner. In addition, the interlocking valves may be three-way valves in which the change over is accomplished by a smaller stroke. It is further understood that a synchronous motor or a stopper and a ball screw with a clutch may be employed instead of using the link mechanism between the cylinders 31 and 41 and valves 30 and 40 of the embodiment shown in FIG. 1.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An interlocking change-over valve system for use with a hydraulically controlled mechanism, the system comprising:

at least first and second hydraulic actuators;

at least one valve corresponding to each of the at least first and second actuators for controlling a hydraulic pressure supplied to said actuator, wherein the corresponding valves of the first and second actuators have spherical valve members deviated 90 degrees from each other;

a hydraulic cylinder connected by a link mechanism to each of the at least one valve for opening and closing said valves to simultaneously alter the supply of hydraulic pressure to the at least first and second actuators; and a control device for remotely activating the hydraulic cylinder to selectively supply hydraulic pressure to some of the plurality of hydraulic actuators.

2. An interlocking change-over valve system for use with a hydraulically controlled mechanism, the system comprising:

at least first and second hydraulic actuators;

at least one valve corresponding to each of the at least first and second actuators for controlling a hydraulic pressure supplied to said actuator, wherein the corresponding valves of the first and second actuators have spherical valve members deviated 90 degrees from each other;

a hydraulic cylinder connected by a link mechanism to each of the at least one valve for opening and closing said valve; and a control device for remotely activating the hydraulic cylinder to selectively supply hydraulic pressure to some of the plurality of hydraulic actuators;

wherein the valves corresponding to the first actuator are open and the valves corresponding to the second actuator are closed to supply hydraulic pressure only to the first actuator when the hydraulic cylinder is in a first position, and wherein the valves corresponding to the first actuator are closed and the valves corresponding to the second actuator are open to supply hydraulic pressure only to the second actuator when the hydraulic cylinder is in a second position.

3. The interlocking change-over valve system according to claim 2, wherein the hydraulic actuators consist of one of the group of hydraulic cylinder actuators and hydraulic motor actuators.

4. The interlocking change-over valve system according to claim 2, wherein a pair of valves correspond to each of the first and second actuators.

5. The interlocking change-over valve system according to claim 2, further comprising an electromagnetic valve connected to the hydraulic cylinder and the control device, wherein the electromagnetic valve controls the supply of hydraulic pressure to the hydraulic cylinder to position the hydraulic cylinder in the first position or the second position based upon a received signal from the control device.

6. The interlocking change-over valve system according to claim 5, wherein the control device is a manually operated push-button lever.

7. An interlocking change-over valve system comprising:

a hydraulically controlled mechanism;

a pair of hydraulic cylinder actuators and a pair of hydraulic motor actuators, said cylinder actuators and motor actuators for controlling the movement of the mechanism;

a pair of valves corresponding to each of the pair of cylinder actuators and the pair of motor actuators for controlling a hydraulic pressure supplied to the actuator;

a first hydraulic cylinder connected by a link mechanism to the valves corresponding to the cylinder actuators for opening and closing the valves to simultaneously alter the supply of hydraulic pressure to both cylinder actuators;

a second hydraulic cylinder connected by a link mechanism to the valves corresponding to the motor actuators for opening and closing the valves to simultaneously alter the supply of hydraulic pressure to both motor actuators;

a first control device for remotely activating the first hydraulic cylinder to selectively supply hydraulic pressure to one of the pair of cylinder actuators; and a second control device for remotely activating the second hydraulic cylinder to selectively supply hydraulic pressure to one of the pair of motor actuators.

* * * * *